US006054914A

United States Patent [19]

Abel et al.

[11] Patent Number: 6,054,914

[45] Date of Patent: Apr. 25, 2000

[54] MULTI-LAYER TRANSFORMER HAVING ELECTRICAL CONNECTION IN A MAGNETIC CORE

[75] Inventors: David Alan Abel; Jay Emil Grabow; David James Levasseur; Donald Burnell Rigdon; Richard Miles Wetzel, all of Watertown, S. Dak.

[73] Assignee: Midcom, Inc., Watertown, S. Dak.

[21] Appl. No.: 09/110,804

[22] Filed: Jul. 6, 1998

[51] Int. Cl.[7] ..... H01F 5/00; H01F 27/28

[52] U.S. Cl. ..... 336/200; 336/232; 336/223; 336/83

[58] Field of Search ..... 336/200, 223, 336/232, 83

[56] References Cited

U.S. PATENT DOCUMENTS

| | | | |
|---|---|---|---|
| 3,765,082 | 10/1973 | Zyetz . | |
| 3,833,872 | 9/1974 | Marcus et al. . | |
| 3,947,934 | 4/1976 | Olson . | |
| 4,547,961 | 10/1985 | Bokil et al. . | |
| 4,785,345 | 11/1988 | Rawls et al. . | |
| 4,942,373 | 7/1990 | Ozawa et al. . | |
| 5,126,714 | 6/1992 | Johnson . | |
| 5,184,103 | 2/1993 | Gadreau et al. . | |
| 5,225,969 | 7/1993 | Takaya et al. . | |
| 5,312,674 | 5/1994 | Haertling et al. . | |
| 5,349,743 | 9/1994 | Grader et al. . | |
| 5,471,721 | 12/1995 | Haertling . | |
| 5,479,695 | 1/1996 | Grader et al. . | |
| 5,515,022 | 5/1996 | Tashiro et al. . | |
| 5,521,573 | 5/1996 | Inoh et al. | 336/180 |
| 5,532,667 | 7/1996 | Haertling et al. . | |
| 5,551,146 | 9/1996 | Kawabata et al. . | |
| 5,583,474 | 12/1996 | Mizoguchi et al. | 336/83 |
| 5,589,725 | 12/1996 | Haertling . | |
| 5,598,135 | 1/1997 | Maeda et al. . | |
| 5,716,713 | 2/1998 | Zsamboky et al. . | |
| 5,821,846 | 10/1998 | Leigh et al. . | |

FOREIGN PATENT DOCUMENTS

| | | | |
|---|---|---|---|
| 59-52811 | 3/1984 | Japan | 336/200 |
| 2 163 603A | 2/1986 | United Kingdom | 336/200 |

*Primary Examiner*—Lincoln Donovan
*Assistant Examiner*—Anh Mai
*Attorney, Agent, or Firm*—Merchant & Gould P.C.

[57] ABSTRACT

A method, apparatus, and article of manufacture for a multi-layer transformer includes a plurality of layers having a magnetic core area disposed on each of the layers forming a magnetic core of the transformer having a primary winding disposed on at least one of the layers, and a secondary winding disposed on at least one of the layers. A plurality of interconnecting vias connect the primary winding between the layers, and a second plurality of interconnecting vias connect the secondary winding between the layers. The interconnecting vias are disposed proximate a center of the magnetic core of the transformer, thus, reducing the overall volume, size, weight, and cost of a transformer while meeting regulatory isolation safety requirements.

27 Claims, 9 Drawing Sheets

FIG. 2
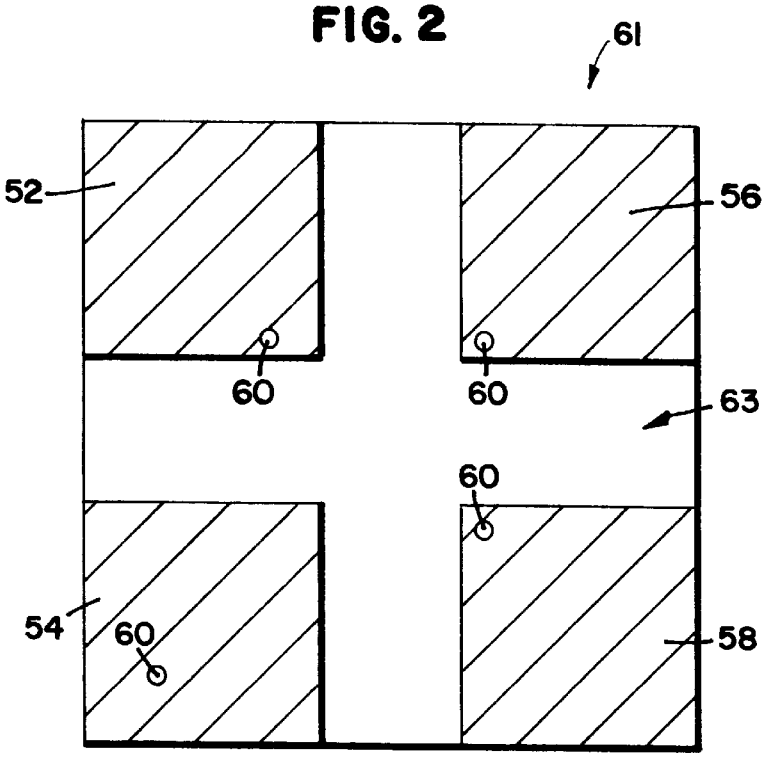
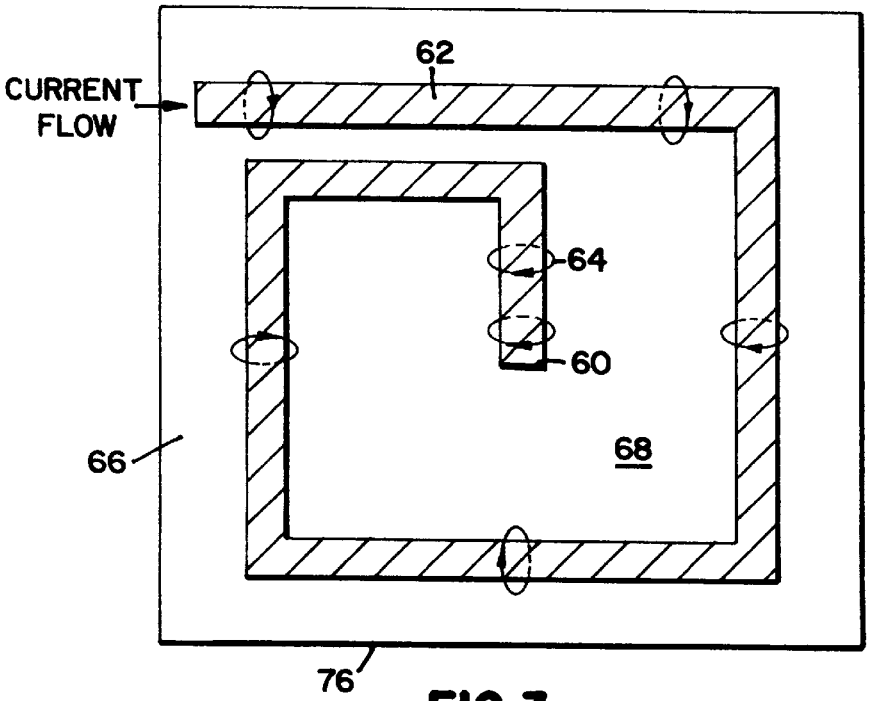
FIG. 3

FIG. 5
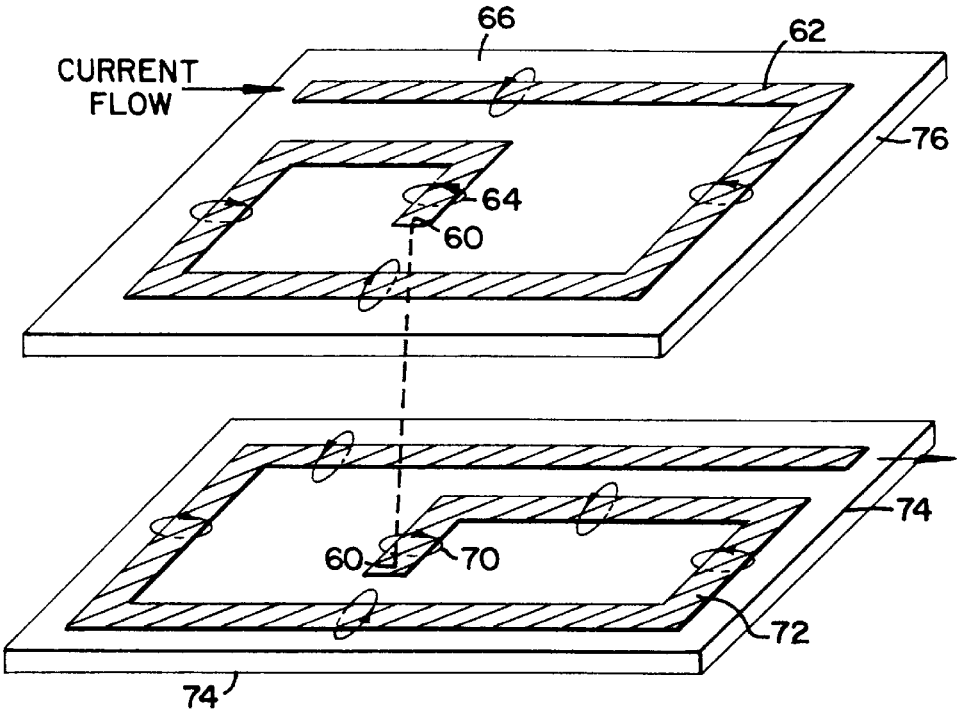
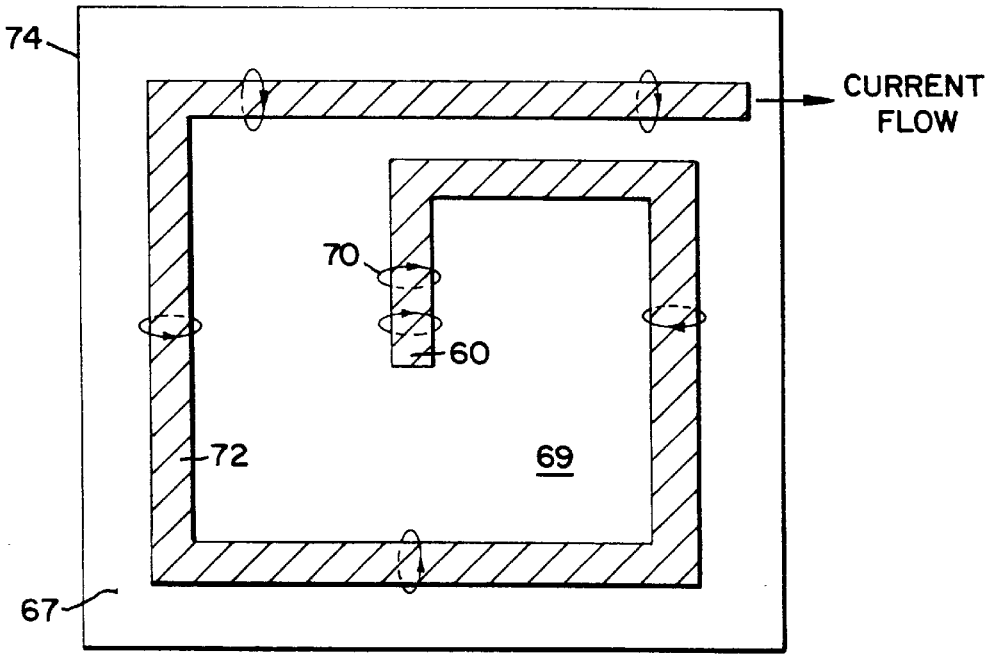
FIG. 4

FIG. 6A
RELATED ART
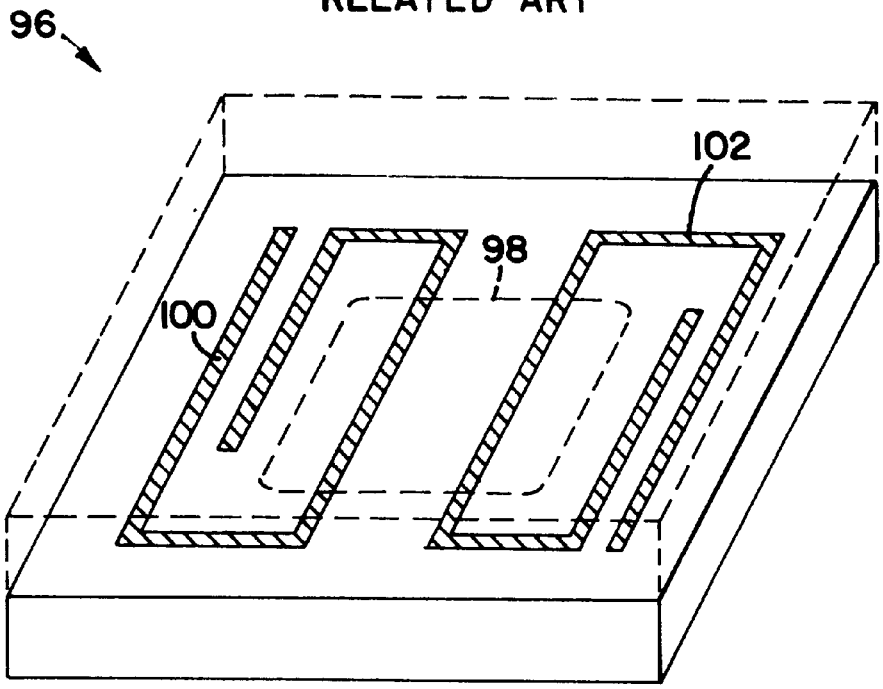
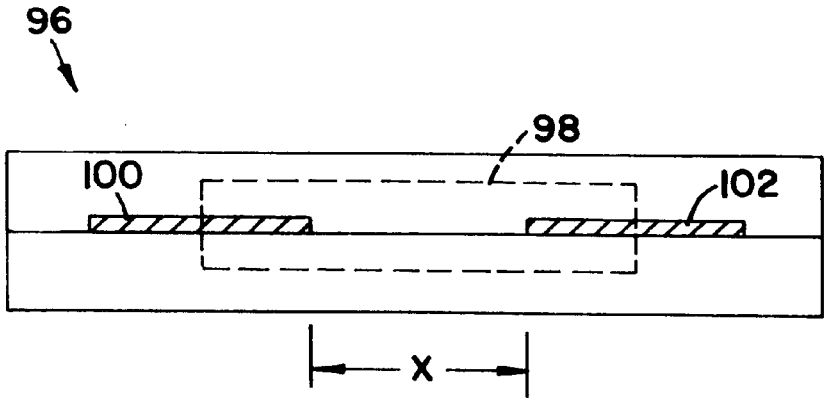
FIG. 6B
RELATED ART

FIG. 8A
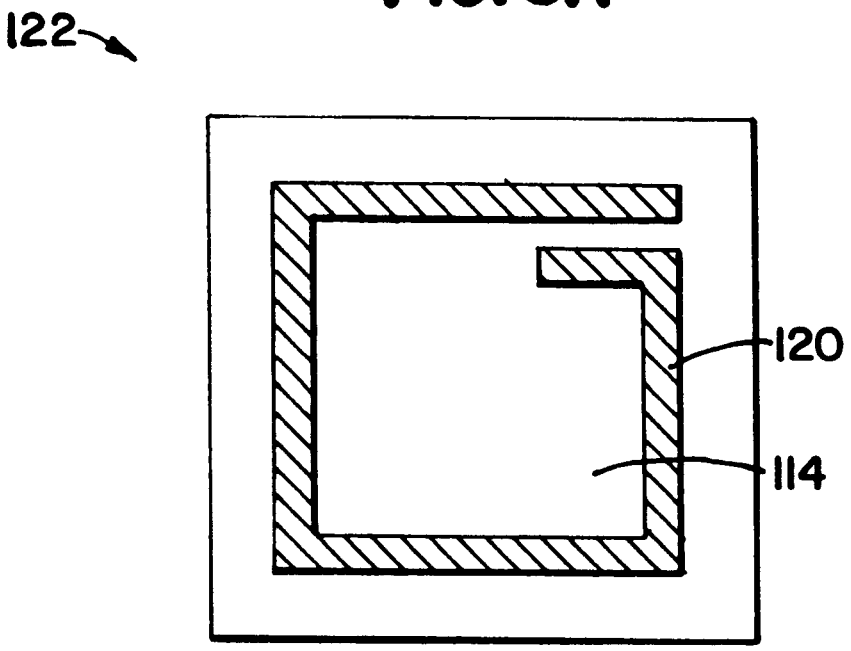
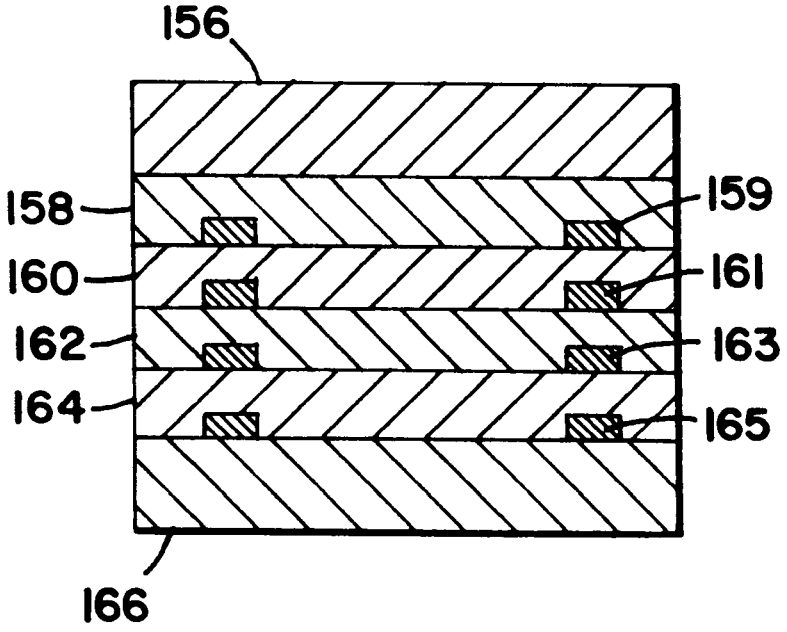
FIG. 8B

MULTI-LAYER TRANSFORMER HAVING ELECTRICAL CONNECTION IN A MAGNETIC CORE

BACKGROUND OF THE INVENTION

1. Field of the Invention

This invention relates to transformers, more specifically, to multi-layer ceramic transformers and methods.

2. Description of Related Art

Transformers of conventional construction incorporate windings and magnetically permeable areas referred to as cores. Windings generally consist of an insulated conductive wire and is usually wrapped around a magnetic core. The windings may also be wrapped around an insulated bobbin which is then placed around a magnetic core. It is common for transformers to incorporate several windings of different turns or wraps to comprise the primary windings and the secondary windings.

Conventional transformers have long incorporated separate magnetic core and winding areas making them restrictive in terms of placing the windings relative to the core. Generally, the windings are wound around the magnetic core, thus adding to the overall size and volume of the transformer. It is impractical, using current construction techniques, to physically pass the windings through the core region. To do this would be very costly and time consuming. Furthermore, most of the possible circuit paths passing through a magnetic core material would induce unwanted magnetic fields in addition to the magnetic fields produced by design. Therefore, wrapping the windings around a magnetic core region limits the options for reducing the size of a conventional transformer. Reducing the size of an isolation transformer is often difficult because the physical size and construction of an isolation transformer play a role in its electrical isolation properties.

In addition to physical size limitations, conventional transformers that are used in telecommunications applications must also conform to regulatory safety standards because to a great extent they are used for isolating user electronic equipment from a communications network, e.g. telephone network. Many regulatory agencies require that a transformer provide a certain voltage isolation barrier and meet certain clearance and creepage distance requirements within the transformer.

Clearance distance, defined as the shortest distance between two conductive parts measured through air, is of particular concern because air, albeit a good insulator, given a strong enough electrical field, will eventually ionize and breach the dielectric barrier.

Creepage distance, defined as the shortest distance between two conducting parts measured along the surface of the insulation, is also of particular importance, because given enough electrical potential between two points on an insulating surface, under suitable environmental conditions, and enough time, the surface of the insulation will eventually break down and lead to a breach in its isolation properties.

Conventional transformers are manufactured to meet distance and voltage isolation requirements by using insulating tapes, cross over tapes, varnish, epoxy, insulating wires and plastic bobbins. These are used in a variety of combinations to ensure that the transformers will withstand the required voltage breakdown limits and the specified distances.

In addition to physical size limitations and electrical insulating properties limitations, a conventional transformer is not easily manufactured in an automated fashion. Conventional wire wound transformers are difficult to manufacture in an automated fashion because of the need to solder winding leads to bobbin terminals. Additionally, wrapping the windings and keeping them away from each other during the manufacturing process is rather difficult and requires a lot of manual labor to assemble. Simple changes in regulatory requirements calling for higher voltage isolation would potentially require additional processing and result in an increase of the transformer's cost beyond what the market will bear.

To overcome the limitations of conventional transformers, a number of methods of manufacturing ceramic transformers have been disclosed. Most of these ceramic transformers do not adequately address electrical isolation requirements, such as the physical requirements needed to give adequate voltage breakdown protection.

Additionally, the conventional ceramic transformers that meet the safety requirements often do not provide adequate performance, such as a poor coupling between coils of a conventional ceramic transformer, etc.

Thus, there is a need in the art for an improved transformer and method, in particular, a low cost, small size, ceramic transformer that can be readily mass produced in an automated fashion and also meet regulatory safety requirements.

SUMMARY OF THE INVENTION

To overcome the limitations in the prior art described above, and to overcome other limitations that will become apparent upon reading and understanding the present specification, the present invention discloses a method and apparatus of providing a multi-layer transformer of reduced physical size and volume without adversely affecting its electrical isolation characteristics.

In one embodiment, the present invention discloses a transformer having a multi-layer tape structure comprising a plurality of layers defining a magnetic core area disposed on at least two of the layers which form a magnetic core of the transformer, a primary winding disposed on at least one of the layers, a secondary winding disposed on at least one of the layers, a first plurality of interconnecting vias connecting the primary winding between the layers, and a second plurality of interconnecting vias connecting the secondary winding between the layers, wherein the first and second interconnecting vias are disposed proximate a center of the magnetic core of the transformer.

Further in one embodiment of the present invention, the layers are made of a cofired-ceramic material.

Still in one embodiment, the cofired ceramic material is a Low-Temperature-Cofired-Ceramic (LTCC) material.

In an alternative embodiment, the cofired-ceramic material is a High-Temperature-Cofired-Ceramic (HTCC) material.

One advantage of the present invention is that the overall volume of the transformer is reduced, and the amount of material required to manufacture the transformer is also reduced which significantly lowers the transformer's overall cost and weight.

The present invention also provides a multi-layer transformer having interleaving windings. In one embodiment, the multi-layer transformer comprises a plurality of layers defining a magnetic core area disposed on at least two of the layers which forms a magnetic core of the transformer, a primary winding disposed on a first layer, a secondary winding disposed on a second layer, the first and second layers being disposed adjacent to each other such that the primary winding and the secondary winding are disposed in an interleaving relationship from one layer to the other.

Still in one embodiment, the transformer further comprises a first plurality of interconnecting vias connecting the primary winding between the layers and a second plurality of interconnecting vias connecting the secondary winding between the layers.

Yet in one embodiment, the first and second interconnecting vias are disposed proximate a center of the magnetic core of the transformer.

Further in one embodiment, the starting and finishing ends of the primary winding are disposed on a same end layer of the plurality of the layers at one end of the transformer.

Still in one embodiment, the starting and finishing ends of the secondary winding, of the multi-layer transformer, are disposed on a same end layer of the plurality of the layers at one end of the transformer.

Still in one embodiment, the starting and finishing ends of the primary and secondary windings, of the transformer, are disposed on a same end layer of the plurality of the layers at one end of the transformer.

In one embodiment, the plurality of layers of the transformer are ferromagnetic cofired-ceramic tapes. The cofired-ceramic tapes are made of Low-Temperature-Cofired-Ceramic (LTCC).

In an alternative embodiment, the cofired-ceramic tapes are made of a High-Temperature-Cofired-Ceramic (HTCC) material.

Still in one embodiment, the primary and secondary windings are primary and secondary electrical conductive member disposed on at least the first and second layers, respectively, within the magnetic core, the primary electrical conductive member on the first layer has an end connecting to an end of the secondary electrical conductive member on the second one of the layers through a via between the first and second layers, the first and second layers adjacent to each other, the electrical conductive members being generally perpendicular to flux lines of the magnetic core, a portion of the first electrical conductive member disposed proximate the via being parallel to a portion of the second electrical conductive member disposed proximate the via, the two portions conducting an equal current in an opposite direction, such that magnetic effect around the via is substantially eliminated.

Further in one embodiment, the primary and secondary windings disposed on adjacent layers are separated by a first distance, the first distance being less than a second distance, the second distance being a spacing distance between two adjacent portions of the primary electrical conductive members of the primary winding on the same layer.

Yet in one embodiment, the primary and secondary windings disposed on adjacent layers are separated by a first distance, the first distance being less than a second distance, the second distance being a spacing distance between two adjacent portions of the secondary electrical conductive member of a secondary winding on the same layer.

Still in one embodiment, the primary and secondary windings disposed on adjacent layers are separated by a first distance, the first distance being less than a second distance, the second distance being a spacing distance between the primary and secondary electrical conductive members of the primary and the secondary windings, respectively.

Further in one embodiment, the primary winding has a spiral shape.

Yet in one embodiment, the secondary winding has a spiral shape.

Still in one embodiment, the primary winding disposed on at least the first layer generates a primary magnetic flux, and the secondary winding disposed on at least the secondary layer is coupled to the primary winding by the primary magnetic flux.

One advantage of the present invention is that flux lines from the transformer are not significantly altered because the net current in the first and second electrical conductive members around the via is zero. Therefore, no significant spurious magnetic fields are introduced in the transformer core area.

Another advantage of the present invention is that the magnetic coupling between the windings is improved significantly.

The present invention also provides a balanced multilayer transformer. In one embodiment, the transformer comprises at least one layer with a winding disposed on the at least one layer, the winding generating a magnetic flux, a magnetic core area formed by the winding, the magnetic core area being substantially perpendicular to the magnetic flux. A plate disposed on top of the at least one layer, the plate providing a return path for the magnetic flux, wherein a total plate cross-sectional area covered by the magnetic flux is substantially equal to the magnetic core area traversed by the magnetic flux.

The present invention also provides a balanced multilayer transformer. In one embodiment, the transformer comprises at least one layer with a winding disposed on the at least one layer, the winding generating a magnetic flux, a magnetic core area formed by the winding, the magnetic core area being substantially perpendicular to the magnetic flux. A plate disposed on top of the at least one layer, the plate providing a return path for the magnetic flux, wherein a total plate cross-sectional area covered by the magnetic flux is greater than the magnetic core area covered by the magnetic flux.

One advantage of the present invention is that a balanced transformer having a balanced cross-sectional area is realized, so that the magnetic flux density for a given size is maximized.

The present invention also provides a ferromagnetic material for a ceramic transformer. In one embodiment, the material comprises a Nickel-Copper-Zinc-Ferrite (NiCuZnFeO) in which a Ferrite (FeO) content is 40%–60% of a total Wt. %. The ferromagnetic material also containing Bismuth (Bi) in an amount not more than 1% of the total Wt. %, and a Zinc-Oxide (ZnO) in an amount not more than 10% of the total Wt. %, wherein the Zinc-Oxide particle size after firing of the ceramic transformer is less than 10 $\mu$m.

These and various other advantages and features of novelty which characterize the invention are pointed out with particularity in the claims annexed hereto and form a part hereof. However, for a better understanding of the invention, its advantages, and the objects obtained by its use, reference should be made to the drawings which form a further part hereof, and to accompanying descriptive matter, in which there are illustrated and described specific examples of an apparatus in accordance with the invention.

BRIEF DESCRIPTION OF THE DRAWINGS

Referring now to the drawings in which like reference numbers represent corresponding parts throughout:

FIG. 2 illustrates a plan view of a top layer of a multi-layer transformer according to the preferred embodiment of the present invention.

FIG. 3 illustrates a transformer winding layer illustrating current flow in one polarity according to the preferred embodiment of the present invention.

FIG. 4 illustrates another transformer winding layer illustrating current flow in an opposite polarity of FIG. 3 according to the preferred embodiment of the present invention.

FIG. 5 illustrates two transformer winding layers as shown in FIGS. 3 and 4 in a stacked arrangement further depicting the current flow in each layer and the corresponding magnetic flux polarity according to the preferred embodiment of the present invention.

FIGS. 6A, B illustrate a magnetic flux path with separate primary and secondary windings on one layer of a conventional multi-layer transformer.

FIGS. 8A, B illustrate a plan view of one layer and a cross-sectional area of a multi-layer transformer according to the preferred embodiment of the present invention.

DETAILED DESCRIPTION OF THE PREFERRED EMBODIMENTS

The present invention provides a transformer having a multi-layer tape structure. The present invention also provides a multi-layer transformer having coupled primary and secondary windings in an interleaving relationship. The present invention further provides a balanced multi-layer transformer. Furthermore, the present invention provides a ferromagnetic material for a transformer.

In the following description of the preferred embodiments, reference is made to the accompanying drawings which form a part hereof, and in which is shown by way of illustration a specific embodiment in which the invention may be practiced. It is to be understood that other embodiments may be utilized and structural changes may be made without departing from the scope of the present invention.

Figure 1B:
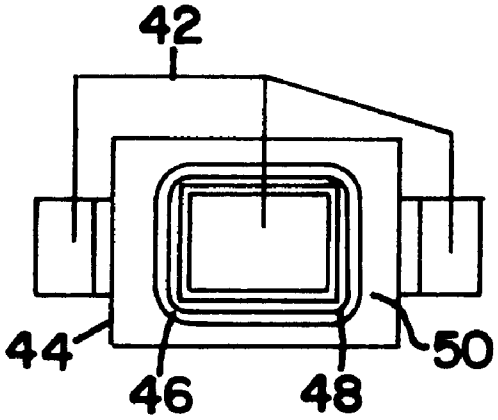
FIG. 1B RELATED ART
FIGS. 1A, B illustrate a side view and a cross-sectional view of a conventional wirewound transformer.
Figure 1A:
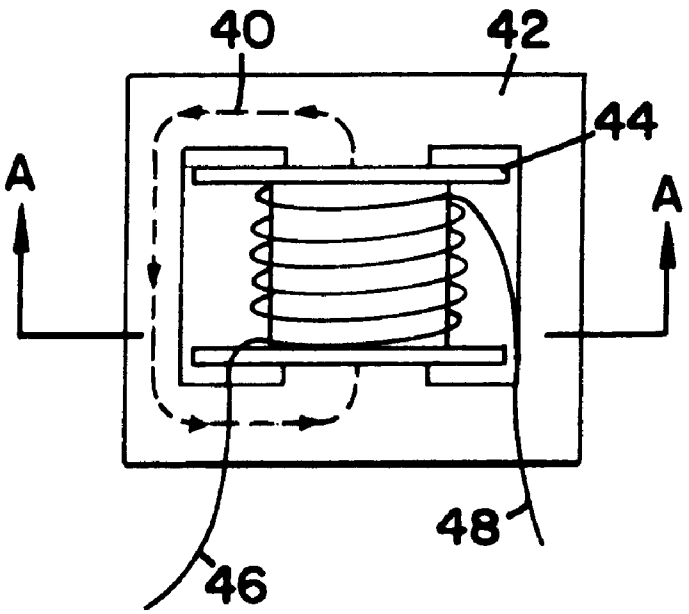
FIG. 1A RELATED ART

FIG. 1A illustrates a side view of a conventional transformer depicting a winding having a starting lead 46 and an ending lead 48 wrapped several times around an insulating bobbin 44. The winding includes an insulated conductive wire. An electric current passing through the windings 46 and 48 generates a magnetic field. The magnetic flux lines are perpendicular to the winding. The magnetic flux lines produced in this manner are concentrated, or enhanced, by passing them through a magnetically permeable core 42 having low reluctance, or resistance, to establishing the flux lines. To further ensure low reluctance, a closed magnetic path 40 is established in the magnetic core 42. Other embodiments of conventional transformers typically have two or more windings comprising primary and secondary windings, requiring at least four lead connections to the core.

FIG. 1B illustrates a cutaway view of cross-sectional area A—A of the conventional transformer of FIG. 1A. The core cross-sectional area is perpendicular to a magnetic flux path 40 (FIG. 1A). It is important to optimize the overall size of the core's cross-sectional area 42 to match the core material's optimal flux density rating and the application's electrical requirements, e.g. inductance. Further depiction of a winding area 50 is also included to clarify that the winding is wrapped around the winding core 42 portion and does not pass through a central portion of the core 42.

FIG. 2 illustrates a top layer of a multi-layer transformer in accordance with the preferred embodiment of the present invention. A top plate 61 of the multi-layer transformer may include four conductive terminal pads and four conducting through holes, referred to as vias 60. The conductive terminal pads correspond to a primary winding starting lead and a primary winding ending lead, 52, 54, respectively. The other conductive terminal pads 56, 58 correspond to a secondary winding starting lead and a secondary winding ending lead, respectively. The top plate 61 and all subsequent layers can be made of a ferrite tape material such as a Low-Temperature-Cofired-Ceramic (LTCC) material or High-Temperature-Cofired-Ceramic (HTCC) material, etc. The primary and secondary windings may be disposed on and interconnected between several layers through the conductive vias 60. The starting and ending leads of the primary and secondary windings terminate on an outer surface 63 ofthe plate 61. Conductive vias 60 are generally located toward an inner portion of the plate 61. In this embodiment, the terminal pads for the primary winding and secondary winding are disposed on the same plate. It is appreciated that the terminal pads for the primary winding and secondary winding can be disposed on different plates or layers.

In FIG. 3, a layer 76 of a multi-layer transformer in accordance with the preferred embodiment of the present invention is shown. A conductive material is printed onto a ferrite tape substrate to form an electrical conductive member or a winding 62. An electric current flowing through the winding 62 generates a magnetic field 64 that is perpendicular to and encircles the winding 62. The polarity of the magnetic field 64 is determined by the direction of the current flow. Each subsequent layer of the multi-layer transformer has similar windings. Each winding having one or more turns with a starting end and a finishing end and is electrically connected to the conductive terminal pads 52, 54, 56, or 58 (FIG. 2) through the conductive vias 60. It is appreciated that the number of turns per primary and secondary windings is determined by a given specification of a transformer. The winding 62 divides the ferrite tape substrate layer into an inner core portion 68 and an outer core portion 66. The conductive vias 60 are preferably located in the inner core portion 68 to reduce the size of the transformer. It is appreciated that the vias or some of the vias can be disposed outside of the inner core portion 68. Accordingly, in one preferred embodiment, all conducting vias may pass through the inner core portion 68 from the layer 76 to an adjacent layer 74 (FIGS. 4 and 5). Utilizing vias 60 to interconnect the conductive windings 62 through the inner core portion 68 significantly reduces the overall volume of the transformer without adversely affecting the transformer's magnetic properties.

FIG. 4 illustrates the layer 74 of a multi-layer transformer in accordance with the preferred embodiment of the present invention. A conductive winding 72 is printed onto a ferrite tape substrate. An electric current flowing through the winding 72 generates a magnetic field 70 that is perpendicular to and encircles the winding 72. The polarity of the magnetic field 70 is determined by the direction of the current and it is of opposite polarity to the magnetic field 64 (FIG. 3) generated on the adjacent layer 76 (FIG. 3) of the transformer. The winding 72 has one or more turns. The starting and finishing ends of the winding can be electrically connected to the conductive terminal pads 52, 54, 56, or 58 (FIG. 2) through the conductive vias 60. The winding 72 divides the ferrite tape substrate of layer 74 into an inner core portion 69 and an outer core portion 67. Conductive via 60 is preferably located on the inner core portion 69. Accordingly, all conducting vias may pass through the inner core portion 69 from the layer 74 to the layer 76. Similarly, the number of turns per primary and secondary windings is determined by a given specification of a transformer.

FIG. 5 further illustrates the layer 76 and the layer 74 of a multi-layer transformer in accordance with the preferred embodiment of the present invention. The layers 76 and 74 can be two adjacent layers of a multi-layer transformer, or can be a two layer transformer. The conductive winding 62 of the layer 76 is electrically connected to the conductive winding 72 of the layer 74 by utilizing the conductive vias 60. The electric current flowing into the winding 62 generates the magnetic field 64 that is opposite in polarity to the magnetic field 70 generated by the conductive winding 72 on the layer 74. The polarity of the magnetic fields 64 and 70 surrounding a portion of the conductive windings 62 and 72 which is located in a central core region of the transformer, directly opposes each other and cancels out. As a result, the net magnetic field in the central core region is thus zero. This feature enables the interconnecting windings to pass through the central core region of the multi-layer transformer without adversely affecting its magnetic properties. In addition, overall volume and cost of the transformer is also reduced.

The preferred embodiment of the present invention provides a balanced, multi-layer transformer, while conforming with the safety standards or requirements for breakdown voltages. Isolation protection up to 1500 VAC may be required in some applications where the transformer is connected between a user's equipment and the telephone line. The isolation voltage between a primary winding and a secondary winding is often required to be about 1.6 times the value without excessive leakage current through the transformer. In one preferred embodiment, the multi-layer transformer may include a layer having a thickness of 0.0035 inches. The thickness of the layer is substantially equal to the distance between the primary and secondary windings. The layer thickness is a function compromise between achieving good magnetic coupling among the windings and providing adequate isolation protection. For example, a thicker layer between the windings provides better isolation than a thinner layer. However, because the windings are further apart, the magnetic coupling for a thicker layer is worse than the magnetic coupling for a thinner layer.

To improve magnetic coupling and isolation characteristic properties between the primary and secondary windings in a multi-layer transformer, the present invention also provides an improved material for the transformer. In one preferred embodiment, the material includes a Nickel-Ferrite base material (NiCuZnFeO) having about 50% weight of ferrite (FeO). To increase the isolation protection or dielectric voltage, the amount of Bi present in the composition of a base material is minimized to trace amounts and the percent content of Zn is also reduced. The base material may be in essence a semiconductor. By reducing the amount of Zn in the composition and milling the Zn particles to diameters of less than 5–10 $\mu$m in size, a threshold voltage is high enough to control a leakage current to an acceptable level. The actual percent content of Zn used in the composition depends on factors such as Zn particle diameter size, the amount of contaminants in the composition, and the overall thickness between primary and secondary windings of a transformer layer, etc. For example, in a preferred embodiment, having a thickness of 0.0035 inches, the Zn content is less than 10% of the Wt % (Weight %) and is less than 4% of the At % (Atomic Weight %). It is appreciated that a different layer thickness may be used based on a desired minimum isolation voltage and leakage current of a particular application. To meet various requirements, the Zn particle diameter size, the percent content, and the layer thickness can be changed or adjusted accordingly within the scope of the present invention.

Generally, improving the coupling coefficient between the individual windings of a transformer also requires controlling the physical layout of the individual windings. Windings are kept physically close together by reducing the thickness of each ceramic layer and by coupling through the central core region as described in FIGS. 3–5. The closer the windings are, the more magnetic flux lines will pass through each winding, thereby increasing the coupling coefficient of the transformer and resulting in better transfer of electrical signals.

FIGS. 6A and B illustrate a cut away view and a cross-sectional view of a conventional transformer 96 having a long magnetic path 98 that results in poor coupling between a primary winding 100 and a secondary winding 102. FIG. 6B further illustrates the primary winding 100 to the secondary winding 102 and a distance X there between which must be maintained to prevent dielectric breakdown. Also, in this conventional transformer, X is the distance between two windings on a same layer.

Figure 7A:
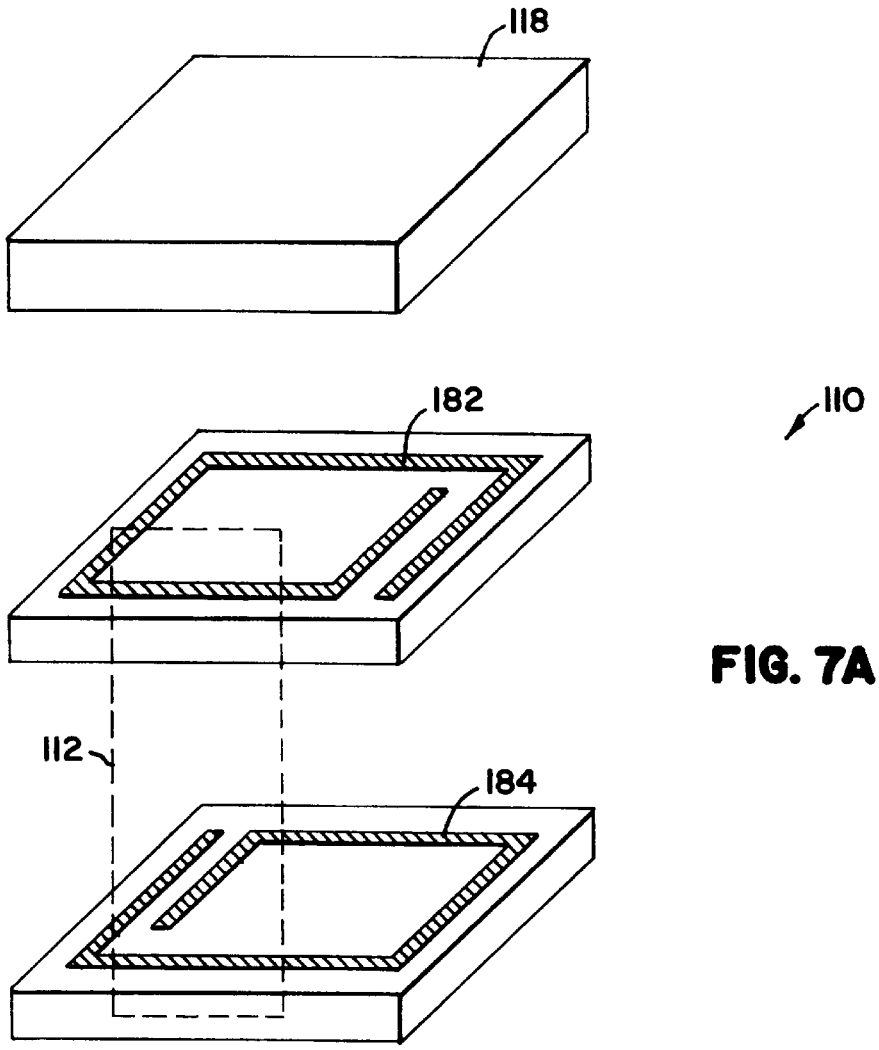
FIGS. 7A, B illustrate a magnetic flux path and primary and secondary windings in close proximity on separate layers of a multi-layer transformer according to the preferred embodiment of the present invention.
Figure 7B:
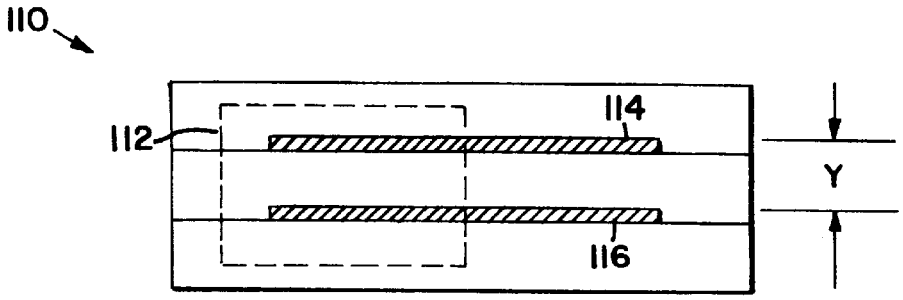

FIGS. 7A and B illustrate a blow up view and a cross-sectional view of a transformer 110, according to the preferred embodiment of the present invention. In this transformer, a much shorter magnetic path 112 is shown which results in a good coupling between a primary winding 182 and a secondary winding 184. In the preferred embodiment of the present invention, the layout of the primary and secondary windings are arranged such that the maximum number of flux lines 112 pass from the primary windings 182 through the center of the magnetic core area and couple with the secondary windings 184. A good coupling pattern, as shown in FIGS. 7A, B, can be obtained by interleaving the primary winding 182 and the secondary 184 winding. Further, each of the windings 182, 184 has a spiral shape to maintain a balanced transformer construction and minimize the distance between windings. In one embodiment, the windings can be in a rectilinear spiral pattern having rounded comers or in a curvilinear spiral pattern. FIG. 7A further illustrates a plate 118 that is mounted on top of the primary or secondary winding layers.

Further, in the preferred embodiment according to the present invention, the distance Y is chosen to be less than the distance X (FIG. 6B). The distance X (FIG. 6B) can range from 0.005 inches to 0.100 inches, and in one preferred embodiment can range from 0.006 inches to 0.050 inches, and further in one preferred embodiment can range from 0.006 inches to 0.010 inches. The distance Y, i.e. a vertical space between any two adjacent windings, is chosen such that it is less than X (FIG. 6B) to optimize the electrical isolation and the magnetic coupling characteristics. The closer the windings are, the greater the coupling is.

FIG. 8A illustrates a plan view of a transformer layer 122 having a magnetic core area 114 formed by the winding 120. FIG. 8B illustrates a cutaway view of a cross-sectional area of several layers of a multi-layer transformer in accordance with the preferred embodiment of the present invention. In FIG. 8B, primary winding layers 158, 162 and primary windings 159, 161, respectively, secondary winding layers 160, 164 and secondary windings 161, 165, respectively, a top plate 156, and a bottom plate 166 are shown.

Figure 9:
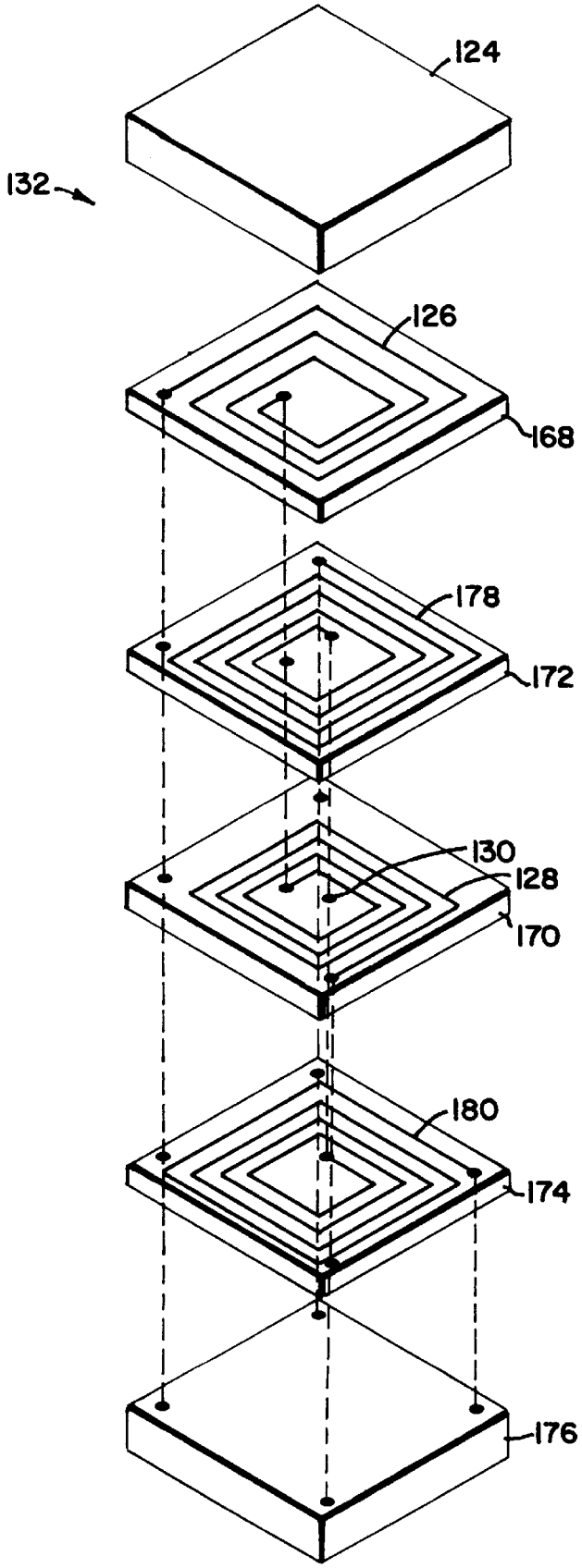
FIG. 9 illustrates an exploded view of a multi-layer transformer according to the preferred embodiment of the present invention.

FIG. 9 is an exploded view of a multi-layer balanced transformer 132 illustrating an end cap (top layer) 124, a bottom cap (bottom layer) 176, primary winding layers 168, 170 having primary windings 126 and 128, respectively, secondary winding layers 172, 174 having secondary windings 178 and 180, respectively, and conductive vias 130. In the preferred embodiment according to the present invention, the primary winding layers 168 and 170 are stacked on alternate adjacent layers. The primary windings 126 and 128 are being substantially aligned on top of each other. Similarly, the secondary winding layers 172 and 174 are stacked on alternate adjacent layers. The secondary windings 178 and 180 are substantially aligned on top of each other. Further, the primary winding 126 and 128 and the secondary windings 178 and 180 are disposed in an interleaving relationship on different layers and substantially aligned to each other to achieve optimal magnetic coupling in the multi-layer transformer. It is appreciated that many arrangements exist for interleaving the primary and secondary windings.

As an example, Table 1 illustrates six different combinations that may be used for interleaving the primary and the secondary windings wherein the windings have a different number of turns. In Table 1, "P/x" denotes the total primary turns and "S/x" denotes the total secondary turns, where x is the total number of turns of that winding.

TABLE 1

| COMBINATION | 1 | 2 | 3 | 4 | 5 | 6 |
|---|---|---|---|---|---|---|
| | P/1 | S/2 | P/2 | S/4 | P/4 | S/6 |
| | S/1 | P/1 | S/1 | P/2 | S/2 | P/3 |
| | | S/2 | P/2 | S/2 | P/2 | S/3 |
| | | | | P/2 | S/2 | P/3 |
| | | | | S/4 | P/4 | S/3 |
| | | | | | | P/3 |
| | | | | | | S/6 |

It is appreciated that many other arrangements can be used for interleaving the primary and secondary windings.

Figure 10:
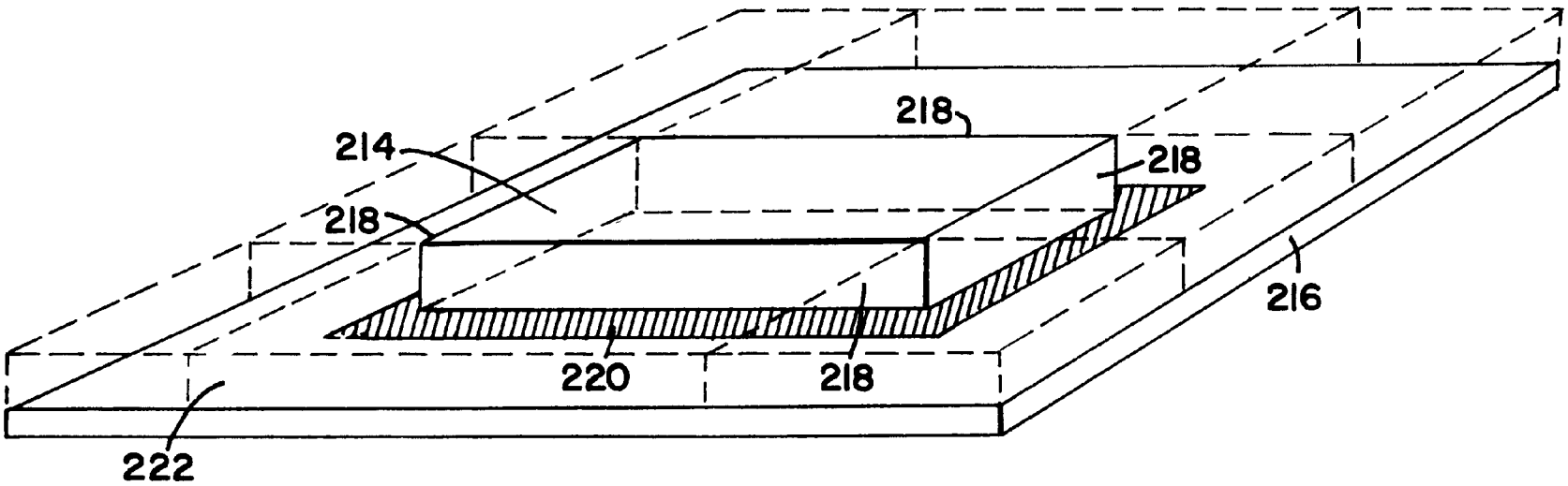
FIG. 10 illustrates areas of a balanced multi-layer transformer according to the preferred embodiment of the present invention.

FIG. 10 is a plan view of the transformer layer 116 illustrating a cut away view of several cross-sectional areas of a multi-layer transformer. FIG. 10 shows an inner core cross-sectional area 214, two side areas 218 of the total top plate, an area of conductive winding 220, and an outside cross-sectional area 222 of the layer 216. The top plate cross-sectional area covered by magnetic flux lines includes all four sides of the top plate area 218 (all four sides are shown).

The parameters illustrated in FIG. 10 determine the overall inductance of the transformer. Inductance can be calculated using the following formula:

$$L=(0.4\pi N^2 A\mu)/l*10^8$$

Where N is the number of turns made by a winding, A is the inner core cross-sectional area 214, $\mu$ is the permeability of the magnetic core, and l is the mean magnetic path length. The overall cross-sectional area of the multi-layer transformer of the present invention is balanced so as to maximize the magnetic field for a given size of the transformer. A balanced core cross-sectional area provides a balanced transformer because the flux path is not restricted in any direction when the flux lines return through the plate cross-sectional area, through the transformer layers and back through the transformer core cross-sectional area.

In one preferred embodiment, a total plate cross-sectional area 218 covered by the magnetic flux includes all four sides and is substantially equal to the magnetic core area 214 covered by the magnetic flux.

In another embodiment, a total plate cross-sectional area 218 covered by the magnetic flux includes all four sides and is greater than the magnetic core area 214 covered by the magnetic flux.

Figure 11A:
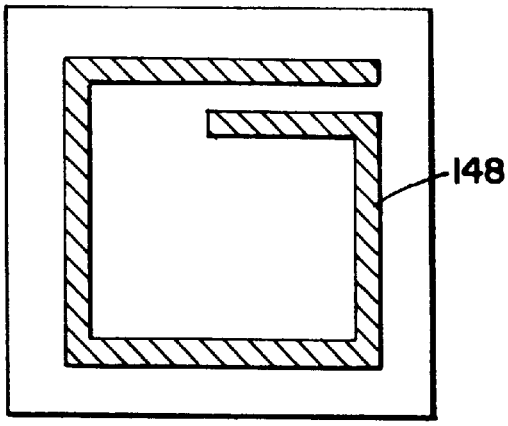
FIGS. 11A, B, and C, illustrate plan views of three examples of different spiral winding patterns according to the preferred embodiment of the present invention.
Figure 11B:
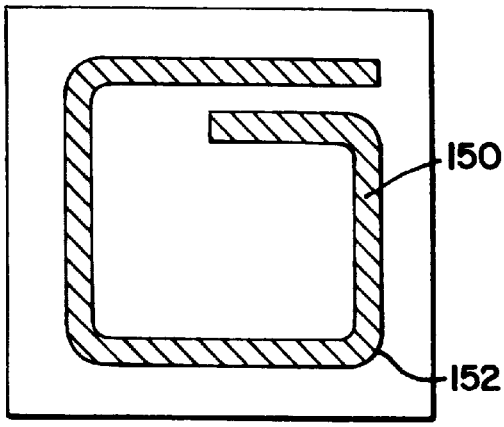
Figure 11C:
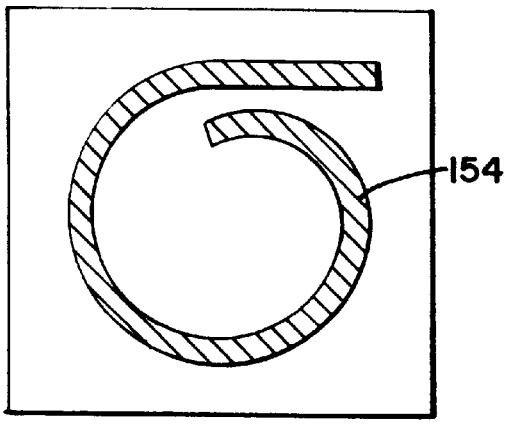

FIGS. 11A, B, and C are plan views of three different examples of winding patterns according to the preferred embodiment of the present invention. These patterns are a rectilinear spiral pattern 148, a rectilinear spiral pattern 150 having rounded comers 152, and a curvilinear spiral pattern 154. The rectilinear pattern 150 with rounded comers and the curvilinear pattern 154 help lower trace capacitance by reducing the total plate area of the spiral winding while providing the required number of turns. Also, rounded corners or curvilinear spirals help reduce the probability of a short circuit between two conductive segments of the windings during the manufacturing process.

The conventional wirewound transformers as shown in FIGS. 1A and B have a long separate core 42 (FIG. 1A) and winding areas 50 (FIG. 1B). The placement of the windings relative to the core 42 (FIG. 1A) is difficult. In the preferred embodiment of the present invention, these limitations are overcome by passing the conductive windings 62, 72 (FIG. 5) through the conductive vias 60, (FIGS. 2, 3, 4, and 5) and through the central core region 68, 69 (FIGS. 3 and 4) of the multi-layer ceramic transformer to obtain compact size, good inductive coupling between the windings, as well as fulfilling safety regulations.

The preferred embodiment of the present invention may be manufactured utilizing cofired ceramic technology. One example is to use Low-Temperature-Cofired-Ceramic-Technology (LTCC). Another example is to use High-Temperature-Cofired-Ceramic-Technology (HTCC). A magnetic core and an electrical insulator are cast into a tape and are made of a ferrite material. The tape is subsequently cut into sheets incorporating, if necessary, registration holes. Vias used as conductive interconnections between layers can be formed as holes in the ferrite tape using various techniques that are well known in the art of ceramic hybrid circuit manufacturing. The vias are made to be electrically conductive by subsequently filling the holes with a conductive material such as silver (Ag), palladium-silver (PdAg), platinum-palladium-silver (PtPdAg), or other conductive materials in the form of a paste or ink commonly used and well known in the art of hybrid circuit manufacturing. Similar conductive elements or compounds are utilized to deposit the conductive transformer windings on the ferrite tape. The conductive vias are thereby terminated and electrically connected to the windings. Vias and windings may be located within the central core region of the transformer layer. Individual ferrite tape layers containing filled vias and deposited conductive winding patterns can then be stacked up one on top of the other with the vias in appropriate alignment, to ensure electrical connectivity between the various layers, during the formation of a multi-layer transformer structure as shown in FIG. 9. The stacked collated layers can then be fused together under conditions such as heat and pressure, etc. and subsequently the entire structure is fired in a furnace, thus, forming a homogenous monolithic ferrite multi-layer transformer. Firing temperatures may range from 1300° C. to 800° C. In one preferred embodiment, firing temperatures may range from 1000° C.–1200° C., or further preferably around 1100° C.

Using the process disclosed herewith, a multitude of transformers may be manufactured simultaneously so as to mass produce them in large quantities by forming a large array of vias and conductive windings on the sheets of ferrite material. Individual transformers can be singulated either before or after firing in the furnace.

Of course, it is appreciated that those skilled in the art would recognize many modifications that can be made to this process and configuration without departing from the spirit of the present invention.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A transformer having a multi-layer tape structure, comprising:

a plurality of layers defining a magnetic core area disposed on at least two of the layers which form a magnetic core of the transformer;

a primary winding disposed on at least one of the layers, the primary winding defining a central core region on the at least one layer;

a secondary winding disposed on at least one of the layers, the secondary winding defining a central core region on the at least one layer;

a first plurality of interconnecting vias connecting the primary winding between the layers; and a second plurality of interconnecting vias connecting the secondary winding between the layers, wherein the first and second interconnecting vias are disposed within the central core regions defined by the primary and secondary windings of the magnetic core of the transformer.

2. The transformer according to claim 1, wherein the layers are made of a cofired ceramic material.

3. The transformer according to claim 2, wherein the cofired ceramic material is a Low Temperature Cofired Ceramic (LTCC) material.

4. The transformer according to claim 2, wherein the cofired ceramic material is a High Temperature Cofired Ceramic (HTCC) material.

5. A multi-layer transformer, comprising:

a plurality of layers defining a magnetic core area disposed on at least two layers which form a magnetic core of the transformer;

a primary winding disposed on a first layer, the primary winding defining a central core region on the first layer;

a secondary winding disposed on a second layer, the secondary winding defining a central core region on the second layer;

the first and second layers being disposed adjacent to each other such that the primary winding and the secondary winding are disposed in an interleaving relationship from one layer to the other.

6. The multi-layer transformer according to claim 5, further comprising:

a first plurality of interconnecting vias connecting the primary winding between the layers; and a second plurality of interconnecting vias connecting the secondary winding between the layers.

7. The multi-layer transformer according to claim 6, wherein the first and second interconnecting vias are disposed within the central core regions defined by the primary and secondary windings of the magnetic core of the transformer.

8. The multi-layer transformer of claim 5, wherein starting and finishing ends of the primary winding are disposed on a same layer of the plurality of the layers of the transformer.

9. The multi-layer transformer of claim 5, wherein starting and finishing ends of the secondary winding are disposed on a same layer of the plurality of the layers of the transformer.

10. The multi-layer transformer of claim 5, wherein starting and finishing ends of the primary and secondary windings are disposed on a same layer of the plurality of the layers of the transformer.

11. The multi-layer transformer of claim 5, wherein the plurality of layers are ferromagnetic cofired ceramic tapes.

12. The multi-layer transformer of claim 11, wherein the ferromagnetic cofired ceramic tapes are made of a Low Temperature Cofired Ceramic (LTCC) material.

13. The multi-layer transformer of claim 11, wherein the ferromagnetic cofired ceramic tapes are made of a High Temperature Cofired Ceramic (HTCC) material.

14. The multi-layer transformer of claim 5, wherein the interleaved primary and secondary windings are substantially aligned over one another.

15. The multi-layer transformer of claim 5, wherein:

the primary and secondary windings are primary and secondary electrical conductive members disposed on at least the first and second layers, respectively, within the magnetic core, the primary electrical conductive member on the first layer has an end connecting to an end of the secondary electrical conductive member on the second one of the layers through a via between the first and second layers, the first and second layers adjacent to each other, the electrical conductive members being perpendicular to flux lines of the magnetic core, a portion of the primary electrical conductive member disposed within the central core region defined by the primary winding being parallel to a portion of the secondary electrical conductive member disposed within the central core region defined by the secondary winding, the two portions conducting about equal currents in an opposite direction and generating about equal magnetic fields having opposite polarity, such that the net magnetic field around the via is substantially eliminated.

16. The multi-layer transformer of claim 15, wherein:

the primary winding disposed on at least the first layer generates a primary magnetic flux; and the secondary winding disposed on at least the secondary layer is coupled to the primary winding by the primary magnetic flux.

17. The multi-layer transformer of claim 5, wherein the primary and secondary windings disposed on adjacent layers are separated by a first distance, the first distance being less than a second distance, the second distance being a spacing distance between two adjacent portions of the secondary electrical conductive member of a secondary winding on the same layer.

18. The multi-layer transformer of claim 5, wherein the primary and secondary windings disposed on adjacent layers are separated by a first distance, the first distance being less than a second distance, the second distance being a spacing distance between the primary and secondary electrical conductive members of the primary and the secondary windings, respectively.

19. The multi-layer transformer of claim 5, wherein the primary winding has a spiral shape.

20. The multi-layer transformer of claim 5, wherein the secondary winding has a spiral shape.

21. The multi-layer transformer of claim 5, wherein the primary and secondary windings disposed on adjacent layers are separated by a first distance, the first distance being less than a second distance, the second distance being a spacing distance between two adjacent portions of the primary electrical conductive members of the primary winding on the same layer.

22. A balanced multi-layer transformer, comprising:

one or more layers;

a winding disposed on at least one of the one or more layers, the winding generating a magnetic flux;

an inner magnetic core area formed by the winding, the magnetic core area being perpendicular to the magnetic flux; and a plate disposed on top of the at least one of the one or more layers, the plate providing a return path for the magnetic flux through a cross-sectional area of the plate;

wherein the cross-sectional area of the plate covered by the magnetic flux is equal to the inner magnetic core area covered by the magnetic flux; and wherein the one or more layers are all formed of one material.

23. A balanced multi-layer transformer according to claim 22, wherein the one or more layers are all formed of a ferromagnetic material.

24. A balanced multi-layer transformer according to claim 23, wherein the ferromagnetic material comprises:

Nickel-Copper-Zinc-Ferrite (NiCuZnFeO) in which a Ferrite (FeO) content is 40%–60% of a total Wt. %;

Bismuth (Bi) in an amount not more than 1% of the total Wt. %; and

Zinc-Oxide (ZnO) in an amount not more than 10% of the total Wt. %, wherein Zinc-Oxide particle size after firing of the ceramic transformer is less than 10 $\mu$m.

25. A balanced multi-layer transformer, comprising:

one or more layers;

a winding disposed on at least one of the one or more layers, the winding generating a magnetic flux;

an inner magnetic core area formed by the winding, the magnetic core area being perpendicular to the magnetic flux; and a plate disposed on top of the at least one of the one or more layers, the plate providing a return path for the magnetic flux through a plate cross-sectional area;

wherein the cross-sectional area of the plate covered by the magnetic flux is greater than the inner magnetic core area covered by the magnetic flux; and wherein the one or more layers are all formed of one material.

26. A balanced multi-layer transformer according to claim 25, wherein the one or more layers are all formed of a ferromagnetic material.

27. A balanced multi-layer transformer according to claim 26, wherein the ferromagnetic material comprises:

Nickel-Copper-Zinc-Ferrite (NiCuZnFeO) in which a Ferrite (FeO) content is 40%–60% of a total Wt. %;

Bismuth (Bi) in an amount not more than 1% of the total Wt. %; and

Zinc-Oxide (ZnO) in an amount not more than 10% of the total Wt. %, wherein Zinc-Oxide particle size after firing of the ceramic transformer is less than 10 $\mu$m.

* * * * *

UNITED STATES PATENT AND TRADEMARK OFFICE

CERTIFICATE OF CORRECTION

PATENT NO. : 6,054,914

DATED : APRIL 25, 2000

INVENTOR(S) : ABEL ET AL.

It is certified that error appears in the above-identified patent and that said Letters Patent is hereby corrected as shown below:

Front Page, [56] References Cited, U.S. Patent Documents: "5,515,022" should read --5,512,022--

Col. 6, line 32: "ofthe" should read --of the--

Signed and Sealed this

First Day of May, 2001

*Attest:*

Nicholas P. Godici

NICHOLAS P. GODICI

*Attesting Officer*

*Acting Director of the United States Patent and Trademark Office*